US005924901A

United States Patent [19]

Takahashi et al.

[11] Patent Number: 5,924,901

[45] Date of Patent: Jul. 20, 1999

[54] OIL RESERVOIR FOR OUTBOARD MOTOR

[75] Inventors: Masanori Takahashi; Kazuyuki Kitajima; Takahide Watanabe, all of Hamamatsu, Japan

[73] Assignee: Sanshin Kogyo Kabushiki Kaisha, Hamamatsu, Japan

[21] Appl. No.: 08/861,525

[22] Filed: May 22, 1997

[30] Foreign Application Priority Data

May 22, 1996 [JP] Japan ..... 8-126723

[51] Int. Cl.[6] ..... B63H 21/38

[52] U.S. Cl. ..... 440/88; 123/196 W

[58] Field of Search ..... 440/88; 123/196 W

[56] References Cited

U.S. PATENT DOCUMENTS

| | | |
|---|---|---|
| 4,452,194 | 6/1984 | Watanabe . |
| 4,498,875 | 2/1985 | Watanabe . |
| 4,611,559 | 9/1986 | Sumigawa . |
| 4,709,671 | 12/1987 | Sumigawa . |
| 4,828,519 | 5/1989 | Watanabe . |
| 5,072,809 | 12/1991 | Shibata . |
| 5,215,164 | 6/1993 | Shibata . |
| 5,232,387 | 8/1993 | Sumigawa . |
| 5,439,404 | 8/1995 | Sumigawa . |
| 5,487,688 | 1/1996 | Sumigawa . |

FOREIGN PATENT DOCUMENTS

| | | | |
|---|---|---|---|
| 5-278686 | 10/1993 | Japan | 440/88 |

*Primary Examiner*—Sherman Basinger
*Attorney, Agent, or Firm*—Knobbe, Martens, Olson & Bear LLP

[57] ABSTRACT

The present invention is an improved oil reservoir for an outboard motor. The oil reservoir is defined by an oil pan portion of an exhaust guide. The exhaust guide includes a support portion which is positioned below an engine powering the motor. The oil pan portion extends downwardly from the support portion. An opening provided in the support portion of the exhaust guide leads to the oil reservoir, serving as an oil return. Preferably, a gasket positioned between the exhaust guide and the engine partially obscures the opening, preventing backflow of oil from the reservoir into the engine when the motor is titled.

10 Claims, 8 Drawing Sheets

OIL RESERVOIR FOR OUTBOARD MOTOR

FIELD OF THE INVENTION

The present invention relates to an outboard motor. More particularly, the present invention is an improved oil reservoir arrangement for a lubricating system of such a motor.

BACKGROUND OF THE INVENTION

Outboard motors powered by internal combustion engines generally include a lubricating system with an oil reservoir. The motor comprises a cowling in which the engine is positioned, and a lower unit extending downwardly from the cowling to a water propulsion unit, such as a propeller.

The engine is generally oriented so that a crankshaft thereof extends vertically. The crankshaft is arranged in driving relation with a drive shaft which extends through the lower unit to a transmission connected to the propeller.

So that gravity may be used to aid a return flow of lubricant from the engine to the reservoir, the oil reservoir is positioned below the engine. Due to the limited space within the cowling, the oil reservoir is generally positioned within the lower unit.

The oil reservoir commonly comprises a tank element which is connected to the bottom side of the engine or a plate element connected to the bottom of the engine with one or more bolts or similar connectors. A supply pipe leads from the tank through the guide to an oil pump, and a return pipe or passage leads through the guide to the tank.

This arrangement suffers from several disadvantages. One problem is that oil often leaks at the connection between the oil tank and the engine wall or plate into the remainder of the motor. This is often the case even when a gasket is positioned between the mating surface of the engine or guide and tank.

Also, manufacture of the motor is complicated by the need to form so many independent motor components, and by the assembly efforts necessary to connect the tank to the plate or engine.

An improved oil reservoir for an outboard motor is desired.

SUMMARY OF THE INVENTION

In accordance with the present invention there is an improved oil reservoir for an outboard motor. Preferably, the motor is of the type having a cowling in which an engine is positioned, and a lower unit depending below the cowling.

In accordance with the present invention, an oil tank is formed integrally with an exhaust guide which is positioned below the bottom end of the engine.

An exhaust passage extends through a support portion of the exhaust guide, with an exhaust manifold of the engine leading to the passage at a top side of the support surface, and an exhaust pipe extending from the passage at a bottom side of the support surface.

In addition, however, the exhaust guide has an opening in the support portion in an area directly below the engine. The opening leads into a reservoir formed by an oil pan portion of the guide which extends downwardly from the support portion.

Preferably, a gasket is positioned between the engine and the top surface of the exhaust guide. This gasket has an opening which is smaller than the opening in the support surface corresponding to the oil reservoir. In this manner, if the motor is titled excessively, the gasket serves as a barrier for preventing back-flow of oil into the engine.

Preferably, the oil pan portion of the exhaust guide is supported at its bottom end by a support plate. The support plate is itself supported by a rib extending into the area within the lower unit.

Further objects, features, and advantages of the present invention over the prior art will become apparent from the detailed description of the drawings which follows, when considered with the attached figures.

DETAILED DESCRIPTION OF THE PREFERRED EMBODIMENTS OF THE INVENTION

In accordance with the present invention, there is provided an improved arrangement for an oil reservoir for an engine of an outboard motor. Generally, the oil reservoir is defined by an integrally formed pan portion of an exhaust guide which is positioned below the engine.

Figure 1:
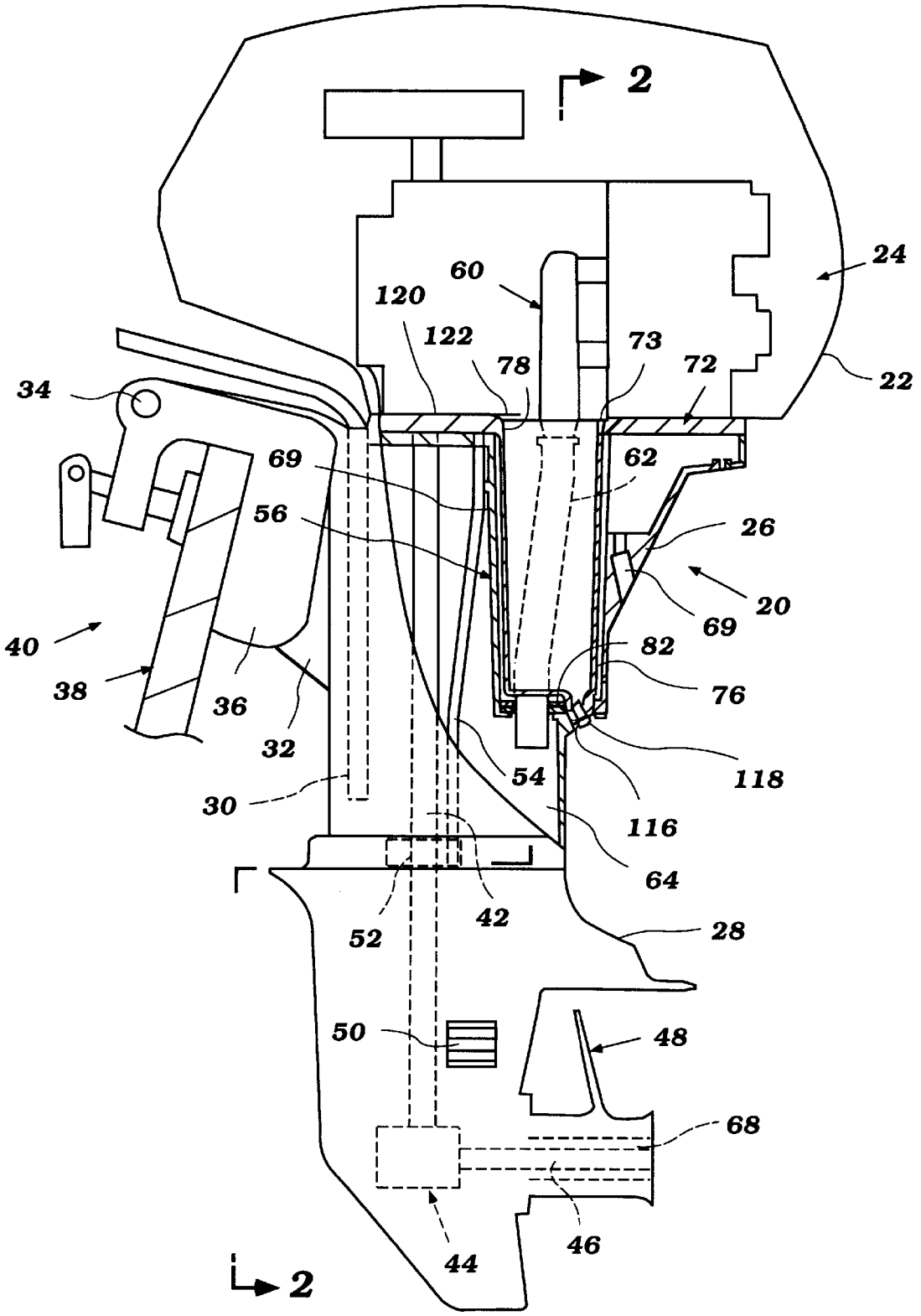
FIG. 1 is a side view, in partial cross-section, illustrating an outboard motor having an oil reservoir in accordance with the present invention

Referring now to FIGS. 1–10, the invention will be described in detail. An outboard motor 20 is illustrated in FIG. 1. The motor 20 has a cowling 22 which encloses an engine 24. A drive shaft housing 26 depends below the cowling 22 to a lower unit 28.

The motor 20 is connected to a steering shaft 30. The steering shaft 30 is supported for steering movement about a vertically extending axis within a swivel or steering bracket 32. The swivel bracket 32 is connected by means of a pivot pin 34 to a clamping bracket 36 which is attached to a transom portion 38 of a hull of the watercraft 40. The pivot pin 34 permits the outboard motor 20 to be trimmed and tilted up about the horizontally disposed axis formed by the pivot pin.

The engine 24 is preferably of the internal combustion type, and preferably operates on a four-cycle principle. The engine may be of the rotary type, or have cylinders arranged in in-line, "V", opposed, flat or other configuration. The engine may have any number of combustion chambers, such as one, two, four, six or more. A member is preferably movably mounted within the engine such that combustion within each combustion chamber effectuates rotation of a crankshaft (not shown) of the engine. The engine 24 is arranged so that its crankshaft is generally vertically extending.

An end of the crankshaft at a bottom end of the engine 24 is connected to a drive shaft 42. The drive shaft 42 extends generally vertically through the drive shaft housing 26 into the lower unit 28 to a transmission 44. The drive shaft 42 drives, via the transmission 44, a propeller shaft 46 having a propeller 48 connected at an opposite end thereof. The transmission may be of the forward-neutral-reverse or other type(s) known to those skilled in the art.

As the particulars of the engine 24 form no part of the present invention, they are not described in detail here. As is well known to those skilled in the art, however, the engine 24 includes an induction system for providing air to each combustion chamber, a fuel system for providing fuel to each combustion chamber, and an ignition system for igniting an air and fuel mixture in each combustion chamber.

Preferably, the engine 24 also includes a cooling system. The cooling system delivers coolant throughout one or more passages or jackets (not shown) throughout the engine 24. The coolant preferably comprises water drawn from the body of water in which the outboard motor 20 is operating.

A coolant inlet 50 is positioned in the lower unit 28 of the motor 20. A supply pipe (not shown) extends to a pump 52 which is driven by the drive shaft 42. A delivery pipe 54 extends from the pump 52 upwardly through the drive shaft housing 26 to the engine 24. After the coolant is routed through the cooling passages in the engine 24, the coolant is preferably routed through a return passage to a coolant pool 56 for cooling oil in an oil reservoir of the engine and for cooling a portion of the exhaust system, as described below. The coolant flows from the pool 56 out of the motor 20 back to the body of water. The pool 56 is preferably formed between a casing forming the drive shaft housing 26, an interior wall 69 of the drive shaft housing 26, and an oil pan portion of an exhaust guide 72, described in more detail below.

An exhaust system is provided for routing exhaust generated by the engine 24 from the engine to a point outside of the motor 20. The exhaust system includes an exhaust manifold 60 connected to the engine 24. The exhaust manifold 60 collects exhaust routed from each combustion chamber through an exhaust passage in the engine 24.

Figure 5:
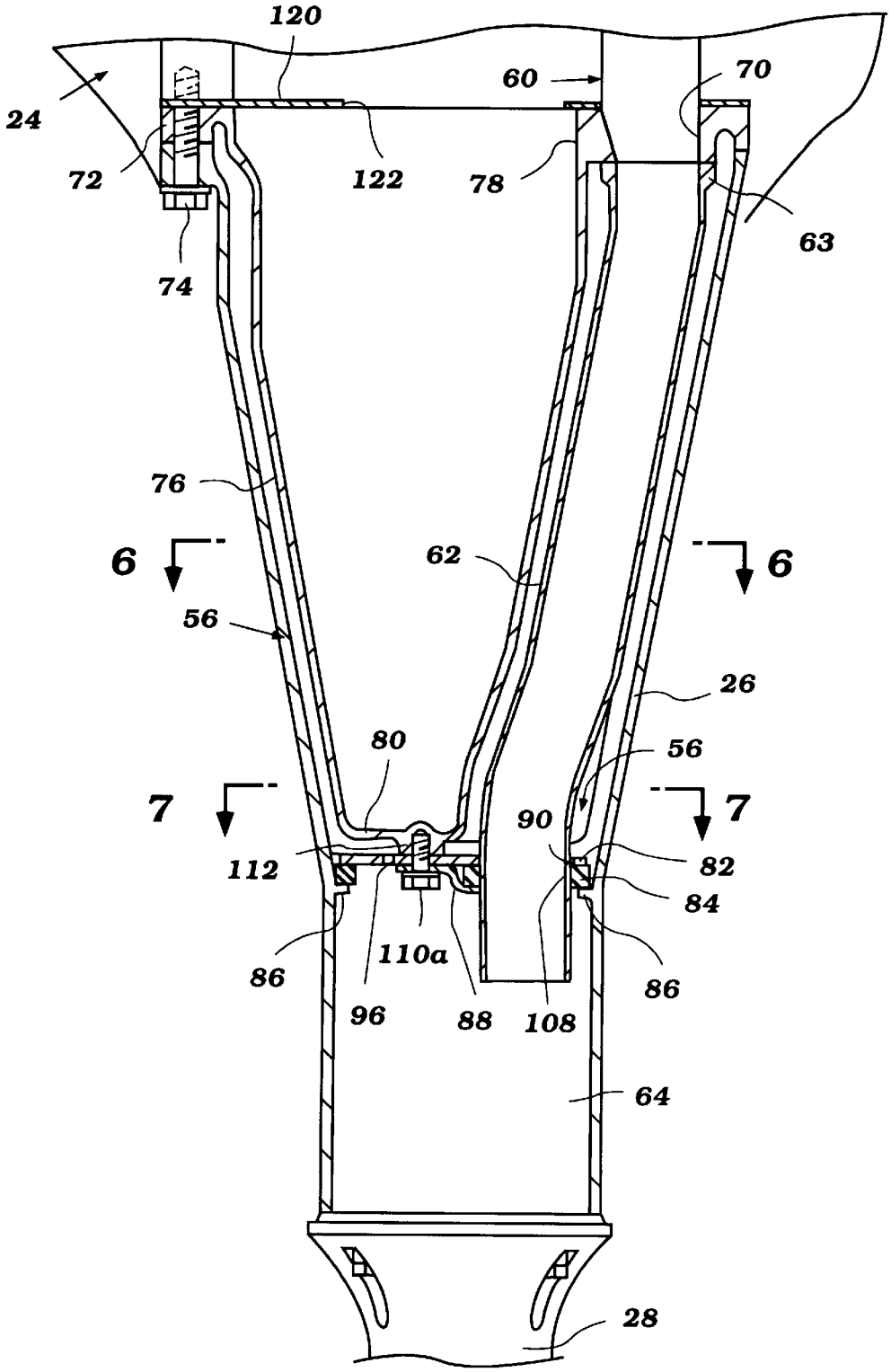
FIG. 5 is a cross-sectional view of that portion of the motor illustrated in FIG. 3, taken along line 5—5 therein.

In addition, the exhaust system includes the exhaust guide 72. The exhaust guide 72 preferably comprises a support portion 71 and an oil pan portion 76. The support portion 71 is a generally planar plate element which is positioned at a bottom end of the engine 22. The support portion 71 extends across the top of the drive shaft housing 26 at its connection to the cowling 24. Preferably, the exhaust guide 72 and drive shaft housing 26 are connected to the cowling 24 with one or more bolts 74, as best illustrated in FIG. 5.

Figure 2:
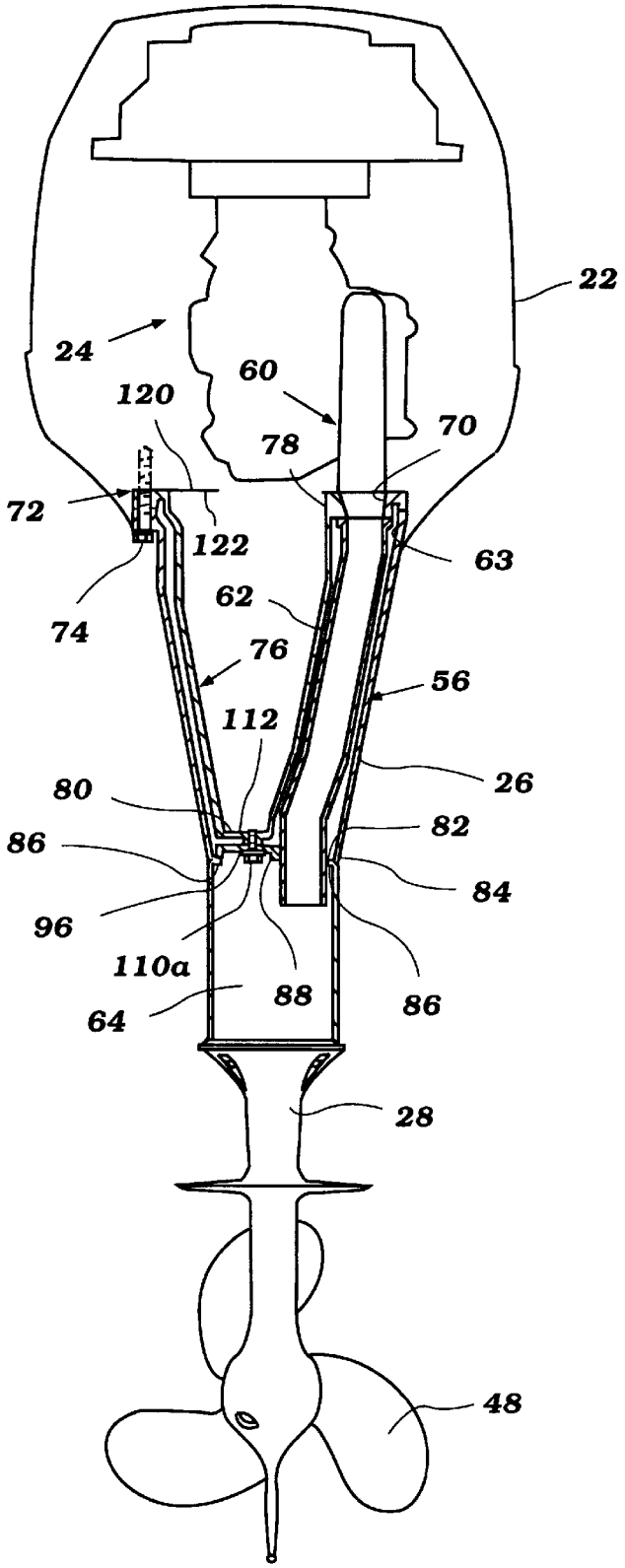
FIG. 2 is a cross-sectional view of the outboard motor illustrated in FIG. 1, taken along line 2—2 therein.
Figure 3:
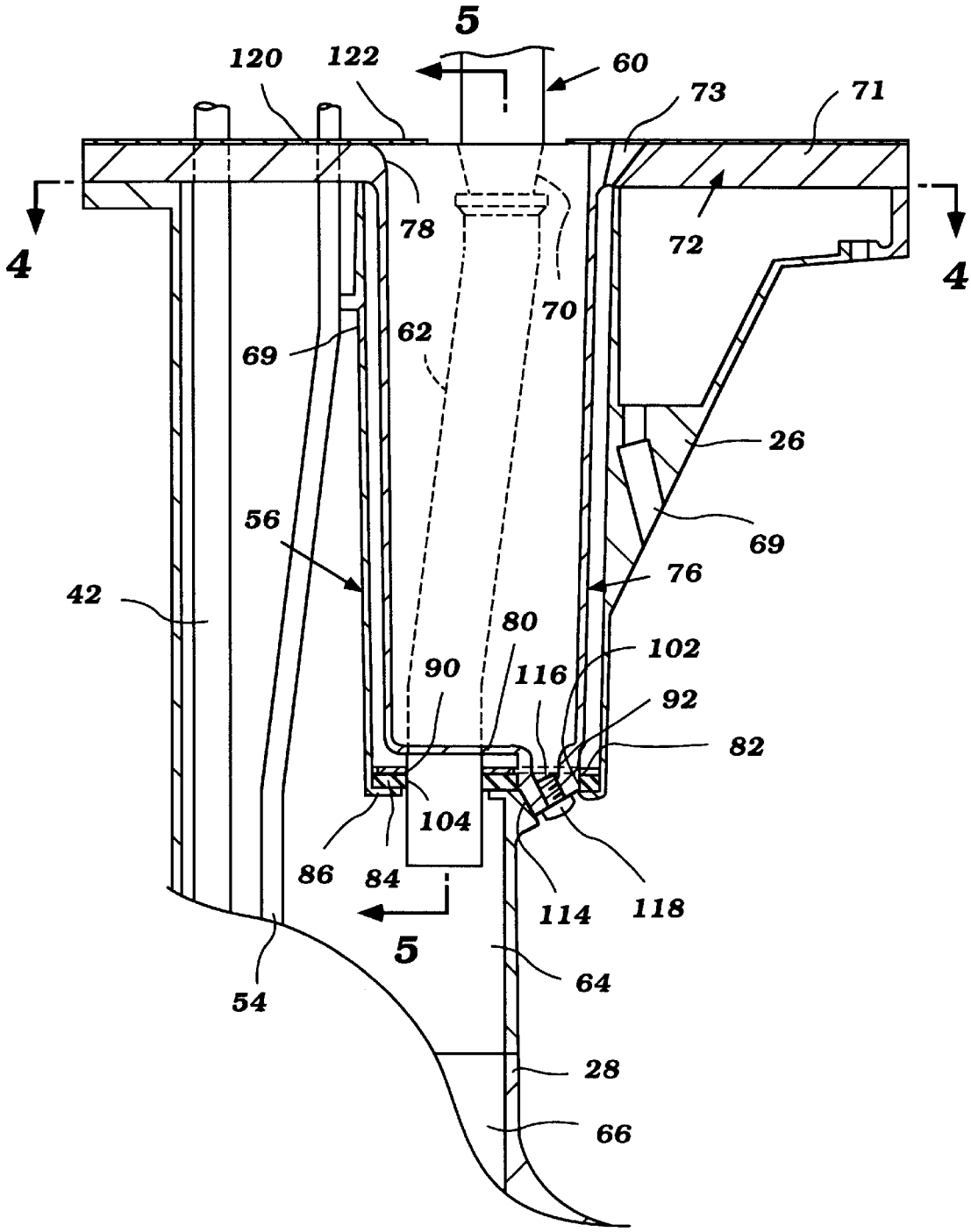
FIG. 3 is an enlarged cross-sectional view of a lower portion of the outboard motor illustrated in FIG. 1.
Figure 4:
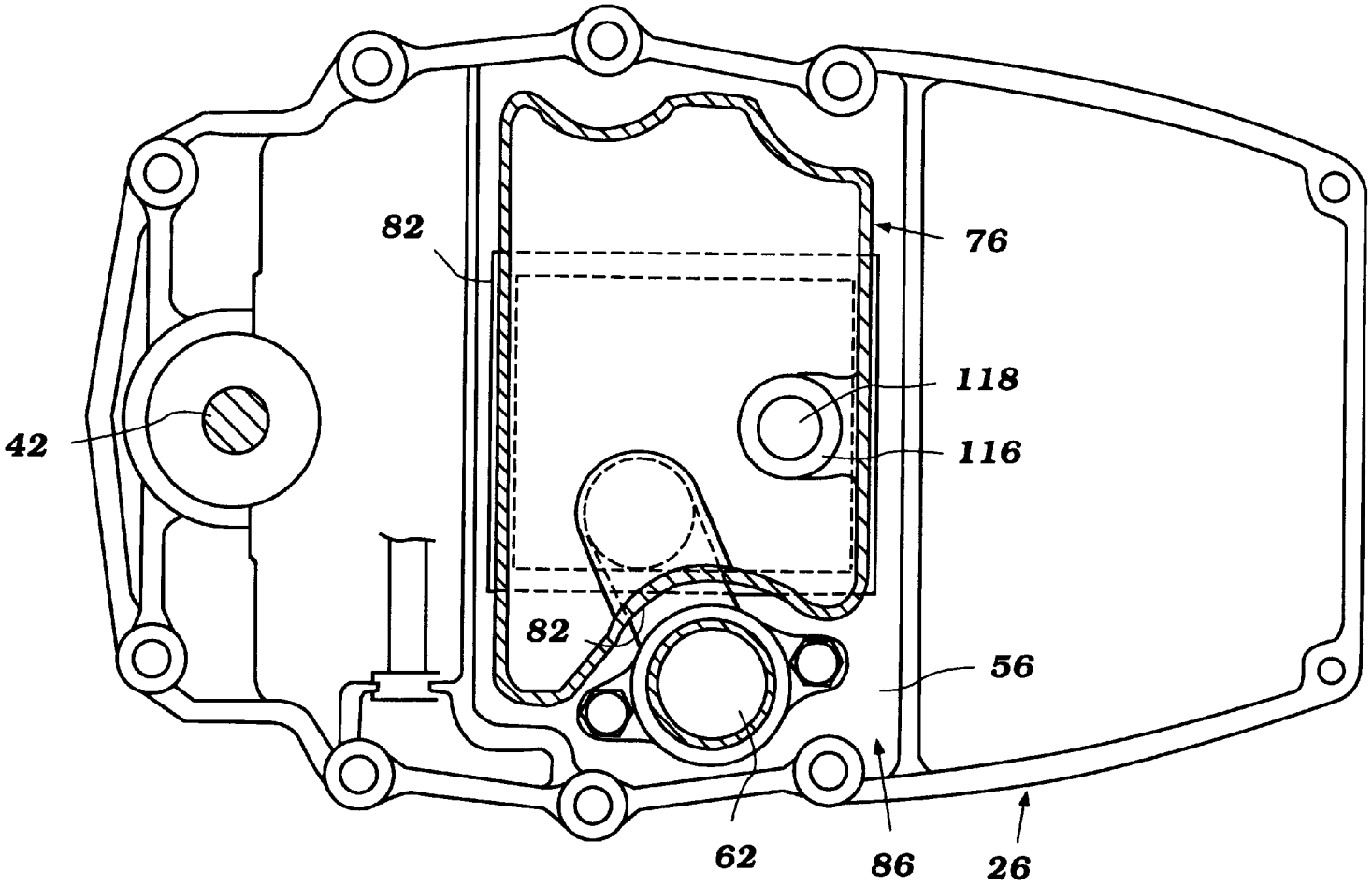
FIG. 4 is a cross-sectional view of that portion of the motor illustrated in FIG. 3, taken along line 4—4 therein.

As best illustrated in FIGS. 2 and 3, the exhaust guide 72 has an exhaust passage 70 leading through the support portion 71 thereof. The exhaust manifold 60 leads to the exhaust passage 70 at a top side of the exhaust guide 72.

An exhaust pipe 62 extends downwardly from a bottom side of the support portion 71 of the exhaust guide 72. A flanged top end 63 of the exhaust pipe 62 is aligned with the exhaust passage 70 through the exhaust guide 70. The exhaust pipe 62 extends downwardly into a muffler 64 positioned within the drive shaft housing 26. As illustrated in FIG. 5, a portion of the exhaust pipe 62 extends through the coolant pool 56 between the oil pan portion 76 and the casing defining the drive shaft housing 26.

An exhaust passage 66 leads from the muffler 64 through the lower unit 28 to a through the hub discharge 68. The exhaust passes through the hub of the propeller 48 and into the body of water in which the outboard motor 20 is positioned.

The particular motor 20 illustrated also includes a low-pressure or idle exhaust passage 69. When the engine 24 is idling or operating a low speed or the exhaust pressure is otherwise low, the exhaust is preferably routed through this passage 69, which is positioned above the waterline when the motor 20 is in a body of water.

As illustrated in FIG. 3, the coolant return path from the engine 24 to the coolant pool 56 preferably includes a return passage 73 through that portion of the exhaust guide 72 adjacent the engine 24.

The engine 24 also includes a lubricating system. The lubricating system includes a reservoir defined by the oil pan portion 76 of the exhaust guide 72. Oil is drawn from the reservoir by a pump (not shown) and delivered through oil passages in the engine 24 for lubricating the engine, as is well known to those skilled in the art. The oil is then returned from the engine 24 to the reservoir by gravity through a return path which includes a return opening 78 in the support portion 71 of the exhaust guide 72 leading to the reservoir defined by the oil pan portion 76.

Advantageously, the exhaust guide 72 comprises a single element, i.e., the oil pan portion 76 and the support portion 71 are formed integrally with one another. In this manner, the upwardly extending walls of the exhaust guide 72 which define the oil pan portion 76 also define the return opening 78.

Figure 6:
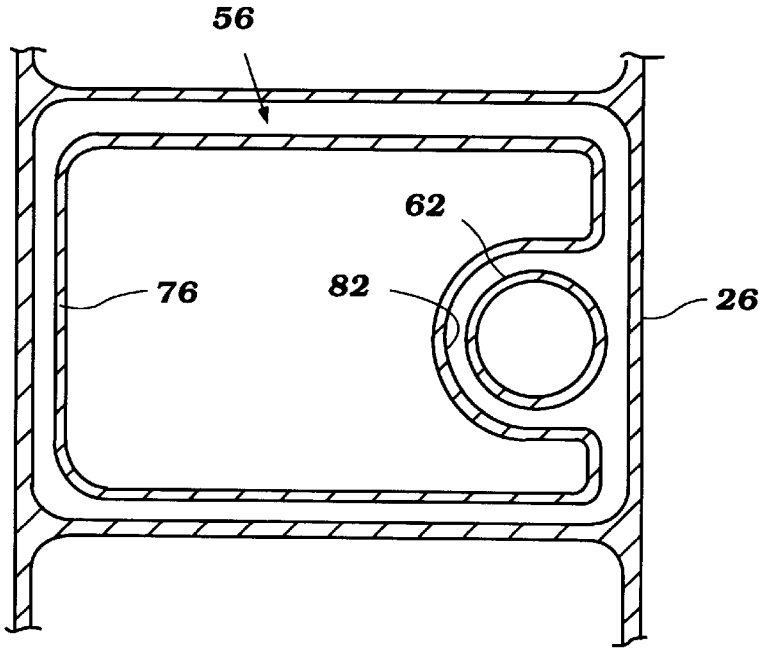
FIG. 6 is a cross-sectional view of the motor illustrated in FIG. 5, taken along line 6—6 therein.

The oil pan portion 76 extends downwardly into the drive shaft housing 26 adjacent the exhaust pipe 62. As best illustrated in FIG. 6, the oil pan portion 76 includes a recessed area 82 accommodating the exhaust pipe 62.

The exhaust guide 72 has a bottom 80 (at the bottom of the oil pan portion 76) positioned above the muffler 64. The bottom 80 of the exhaust guide 72 is supported by a support plate 82. The support plate 82 rests upon a gasket or seal 84 which abuts an inwardly extending flange or rib 86 on its opposite side. This rib 86, as illustrated in FIG. 5, extends inwardly from the casing defining the drive shaft housing 26. Further, a pressure plate 88 is positioned on the opposite side of the seal 84 from the support plate 82.

Figure 7:
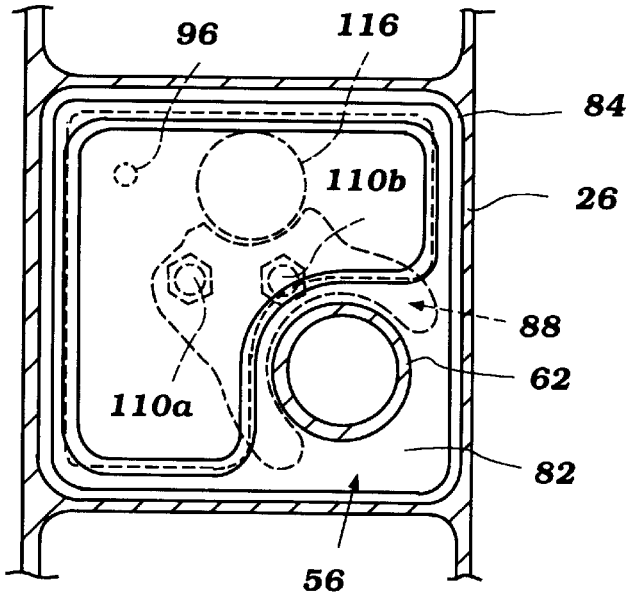
FIG. 7 is a cross-sectional view of the motor illustrated in FIG. 5, taken along line 7—7 therein.
Figure 8:
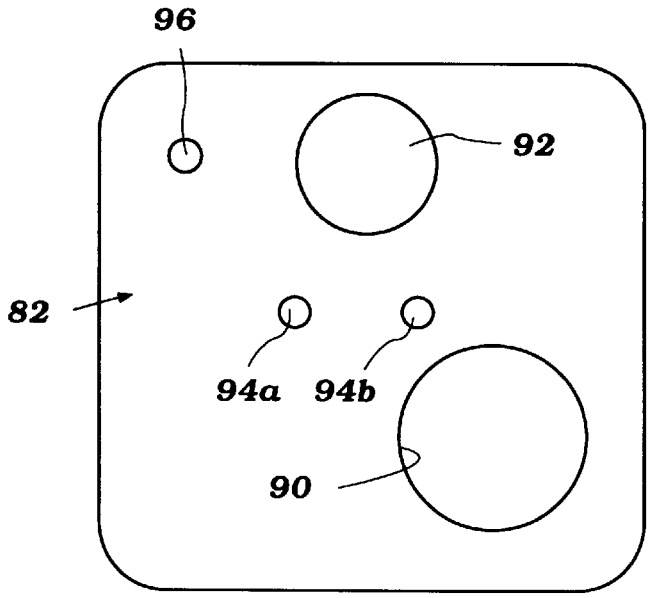
FIG. 8 is a top view of a support plate of the motor of the present invention.

Referring to FIG. 8, the support plate 82 is generally square in shape, and is preferably a thin but fairly rigid sheet of metal. The plate 82 has a first generally circular passage 90 therethrough, through which the exhaust pipe 62 extends when installed (see FIG. 7). In addition, a second passage 92 is provided for an oil reservoir drain, described in more detail below.

First and second bolt holes 94*a,b* are provided in the plate 82 for use in connecting the plate 82 to the oil pan 76, as described in more detail below. In addition, a small port 96 is provided in the plate 82, allowing coolant to flow through the plate from the pool 56 into the muffler 64. The coolant which passes through the port 96 is discharged along with the exhaust flowing through the muffler 64 and passages 66,68 to and through the hub of the propeller 48.

Figure 9:
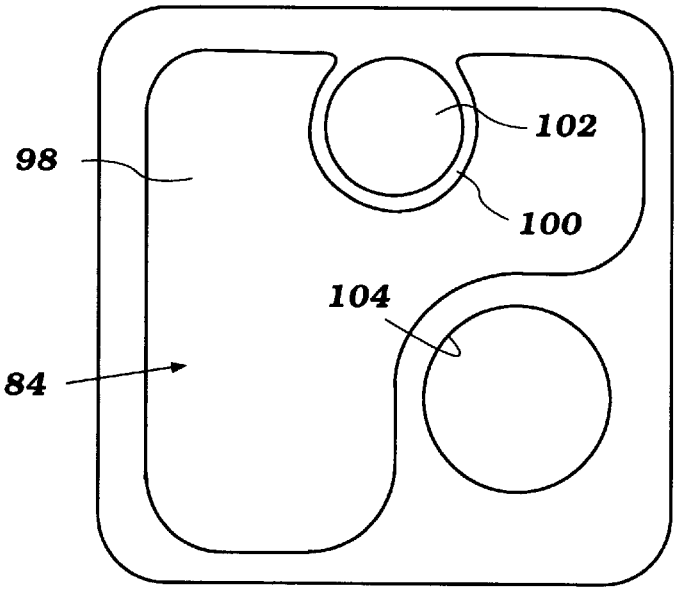
FIG. 9 is a top view of a seal of the motor of the present invention.

The seal 84 is best illustrated in FIG. 9. The seal 84 preferably comprises a resilient rubber or similar material. The seal 84 is also generally square in outer shape, having an outer dimension which is just slightly larger than that of the plate 82.

The seal 84 has an "L"-shaped opening 98 which generally corresponds to the bottom 80 of the pan 76 when installed. A ring-shaped segment 100 of the seal 84 extends into the "L"-shaped opening 98, the segment 100 defining a circular opening 102 for the oil reservoir drain. In addition, a circular hole 104 is provided through the seal 84 through which the exhaust pipe 62 passes when the seal is installed (see FIG. 7).

Figure 10:
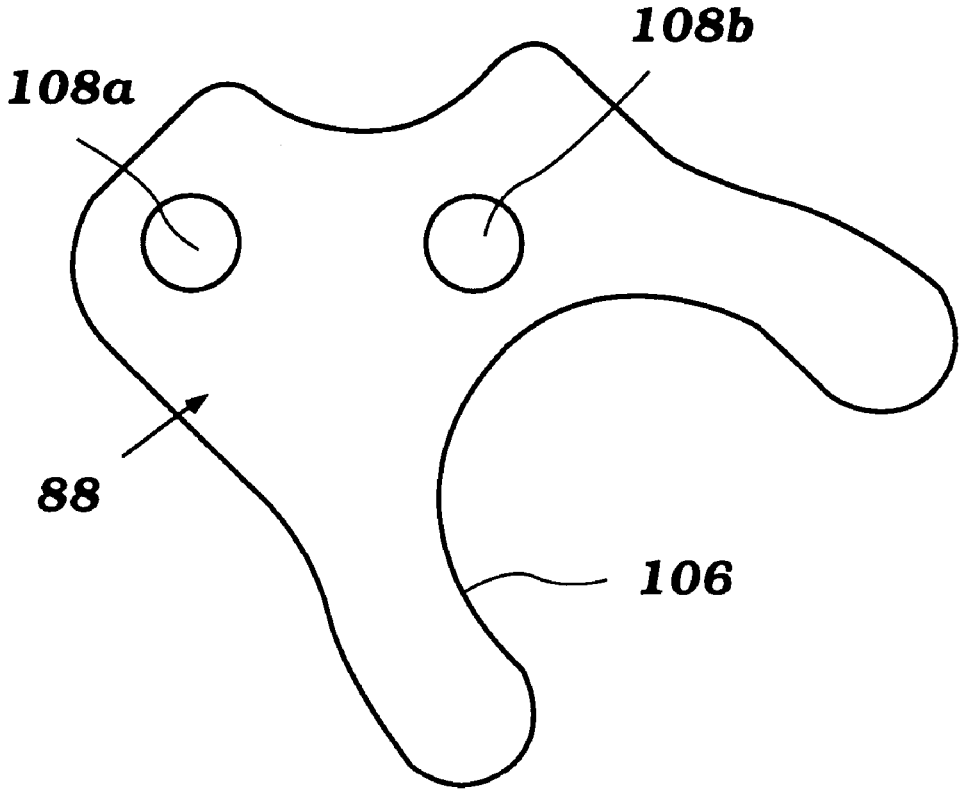
FIG. 10 is a top view of a pressure plate of the motor of the present invention.

Referring to FIG. 10, the pressure plate 88 is a generally flat plate, preferably constructed from metal or a similar rigid and durable material. The plate 88 has a "C"-shaped section 106 for engaging the exhaust pipe 62 in the manner illustrated in FIG. 7. In addition, the plate 88 has a pair of bolt holes 108*a,b* through which a bolt may pass.

As best illustrated in FIGS. 5 and 7, the perimeter of the seal 84 is arranged to seat on the inwardly extending rib 84. The support plate 82 is positioned on top of the seal 84. The pressure plate 88 is positioned below the seal 84, except for an upwardly extending portion of the plate 88 which engages the portion of the support plate 82 unobscured through the "L"-shaped opening 98 in the seal 84.

First and second bolts 110*a,b* extend upwardly through the pressure plate 88 (through bolt holes 108*a,b*), the support plate 82 (through bolt holes 94*a,b*) and into a boss 112 extending formed in the bottom 80 of the exhaust guide 72. The bolts 110*a,b* tightly secure the exhaust guide 72, support plate 82, seal 84 and pressure plate 88. When mounted, the pressure plate 88 also secures the exhaust pipe 62 within the section 106.

As best illustrated in FIGS. 1 and 3, the oil reservoir includes a drain. A passage 114 is formed through the casing defining the drive shaft housing 26. A neck 116 portion of the pan 76 extends downwardly through the passage 92 in the support plate 82 and passage 102 in the seal 84 into this passage 114. The neck 116 is preferably internally threaded, for removable location therein of a threaded plug 118. When the plug 118 is removed, the oil within the oil reservoir defined by the oil pan portion 76 of the exhaust guide 72 may be drained therefrom.

Preferably, a gasket 120 is provided at the top of the exhaust guide 72 between the support portion 71 thereof and the engine 24, as best illustrated in FIGS. 1, 3 and 5. This gasket 120 has an opening 122 therein. The opening 122 is slightly smaller than the return 78 opening at the top end of the reservoir, but is aligned therewith. In this manner, a portion of the gasket 120 extends across the opening 78, serving as a wall which prevents the backflow of oil into the engine 22 in the event the motor 20 is tilted excessively. In the embodiment illustrated, the portion of the gasket 120 which obscures the opening 78 is greater on the watercraft side of the opening 78, as this is the direction in which the motor 20 is most often tilted.

The oil reservoir arrangement of the present invention has several advantages. First, the exhaust guide and oil pan are simply formed during manufacturing as a single element. Further, during assembly of the engine, the step of connecting the oil pan to the exhaust guide is eliminated. Also, since the oil pan and exhaust guide are integrally formed, no oil may leak from the reservoir into the remainder of the engine.

Of course, the foregoing description is that of preferred embodiments of the invention, and various changes and modifications may be made without departing from the spirit and scope of the invention, as defined by the appended claims.

What is claimed is:

1. An outboard motor comprised of a power head consisting of an internal combustion engine and a surrounding protective cowling, a driveshaft housing and lower unit depending from said power head and containing a propulsion device driven by said engine, said driveshaft housing and lower unit being comprised of an outer housing element having an open upper end having a first peripheral edge, an exhaust guide supported upon said open upper end and closing at least in part said open upper end, said exhaust guide having a second peripheral edge, said first and second peripheral edges being coextensive such that said first peripheral edge does not extend beyond said second peripheral edge, said engine being supported directly upon said exhaust guide, an oil reservoir defined by an oil pan portion of said exhaust guide, said oil pan extending downwardly from the portion of said exhaust guide supported upon said outer housing element and formed integrally with said exhaust guide, said exhaust guide positioned below said engine, and said exhaust guide having an exhaust passage therethrough for routing exhaust gas from said engine to an exhaust pipe.

2. The outboard motor in accordance with claim 1, wherein said exhaust guide has an opening therein leading to said reservoir defined by said oil pan portion of said exhaust guide.

3. The outboard motor in accordance with claim 2, wherein a gasket is positioned between said engine and said exhaust guide.

4. The outboard motor in accordance with claim 3, wherein said gasket has an opening therein corresponding to said opening in said exhaust guide, said opening in said gasket being smaller than said opening in said exhaust guide.

5. The outboard motor in accordance with claim 3, wherein a portion of said gasket extends over said opening in said exhaust guide.

6. The outboard motor in accordance with claim 1, wherein said oil pan portion has a bottom end, said bottom end supported by a support plate connected to said outboard motor.

7. The outboard motor in accordance with claim 1, wherein said oil pan portion has a drain at a bottom end thereof, said drain extending to a discharge positioned outside of said outboard motor.

8. The outboard motor in accordance with claim 1, wherein a drive shaft of said motor extends through said exhaust guide for driving the propulsion device.

9. The outboard motor in accordance with claim 1, further including an exhaust pipe affixed to the underside of the exhaust guide and depending along one side of the oil reservoir into a muffler formed in the drive shaft housing and lower unit.

10. The outboard motor in accordance with claim 9, wherein the oil reservoir is formed with a recessed area to one side of the exhaust pipe to form a gap therebetween.

* * * * *